US011286929B2

(12) United States Patent
Ickert et al.

(10) Patent No.: US 11,286,929 B2
(45) Date of Patent: Mar. 29, 2022

(54) VACUUM PUMP SEALING ELEMENT

(71) Applicant: Schwäbische Hüttenwerke Automotive GmbH, Aalen-Wasseralfingen (DE)

(72) Inventors: Roman Ickert, Aulendorf (DE); Stefan Küchle, Erolzheim (DE); Volker Stöhr, Moosburg (DE); Tobias Iser, Elchingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 92 days.

(21) Appl. No.: 16/291,489

(22) Filed: Mar. 4, 2019

(65) Prior Publication Data

US 2019/0277282 A1 Sep. 12, 2019

(30) Foreign Application Priority Data

Mar. 6, 2018 (DE) ..... 102018105142.5

(51) Int. Cl.
*F04C 27/02* (2006.01)
*F04C 28/26* (2006.01)
(Continued)

(52) U.S. Cl.
CPC ..... *F04C 15/0007* (2013.01); *F04C 2/32* (2013.01); *F04C 11/001* (2013.01);
(Continued)

(58) Field of Classification Search
CPC ..... F04C 27/02; F04C 25/02; F04C 28/265; F04C 11/005; F04C 2/102; F04C 27/005;
(Continued)

(56) References Cited

U.S. PATENT DOCUMENTS 1,719,135 A * 7/1929 Roessler ..... F01C 1/344 418/255
2,439,258 A * 4/1948 Matricon ..... F04C 27/02 418/88

(Continued)

FOREIGN PATENT DOCUMENTS

DE 2922951 A1 12/1979
DE 112008002432 T5 7/2010

(Continued)

OTHER PUBLICATIONS

English copy of EP 2626510 by ESpacenet, Jul. 14, 2021.*
German Search Report issued in German Patent Application No. 10 2018 105 142.5 dated Feb. 8, 2019, 8 pages.

*Primary Examiner* — Deming Wan
(74) *Attorney, Agent, or Firm* — RatnerPrestia

(57) ABSTRACT

A rotary pump, preferably a vacuum pump, featuring: a delivery space including an inlet on a low-pressure side and an outlet on a high-pressure side of the pump; a rotor which is arranged in the delivery space and delivers a fluid from the inlet into the delivery space to the outlet from the delivery space; at least one housing part which delineates the delivery space at least axially; and a drive shaft which is connected in drive terms to the rotor; including at least one sealing element which is connected, secured against shifting and/or rotating, to the drive shaft and/or rotor and forms a radial sealing gap with the housing part.

15 Claims, 3 Drawing Sheets

(51) Int. Cl.

| | |
|---|---|
| ***F04B 53/16*** | (2006.01) |
| ***F01M 1/02*** | (2006.01) |
| ***F04B 41/06*** | (2006.01) |
| ***F04C 27/00*** | (2006.01) |
| ***F04C 23/00*** | (2006.01) |
| ***F04C 15/00*** | (2006.01) |
| ***F04C 2/32*** | (2006.01) |
| ***F04C 11/00*** | (2006.01) |
| ***F04C 29/00*** | (2006.01) |
| ***F04C 25/02*** | (2006.01) |

(52) U.S. Cl.
CPC ..... *F04C 23/001* (2013.01); *F04C 25/02* (2013.01); *F04C 27/006* (2013.01); *F04C 27/009* (2013.01); *F04C 29/0071* (2013.01); *F04C 2230/60* (2013.01); *F04C 2240/50* (2013.01); *F04C 2240/605* (2013.01); *F04C 2270/17* (2013.01)

(58) Field of Classification Search
CPC ..... F04C 27/009; F04C 23/005; F04C 2/34; F04C 2/344; F04B 53/16; F04B 41/06; F01M 1/02; F04D 25/16; F01C 1/344; F03C 2/30
See application file for complete search history.

(56) References Cited

U.S. PATENT DOCUMENTS 2,929,550 A * 3/1960 Sadler ..... F04C 18/324 418/67
2,935,023 A * 5/1960 Pribonic ..... B62D 5/07 417/199.1
3,237,851 A * 3/1966 Blanc, Jr. ..... F04C 27/02 418/13
3,695,789 A * 10/1972 Jansson ..... F01C 21/003 418/75
3,778,192 A * 12/1973 Caffrey ..... F04C 28/06 417/286
3,898,810 A * 8/1975 Ohba ..... B60T 8/4031 60/413
4,274,817 A 6/1981 Sakamaki et al.
4,497,618 A * 2/1985 Anderson ..... B62D 5/07 417/368
4,512,728 A * 4/1985 Nakano ..... B60H 1/3223 418/213
4,621,982 A * 11/1986 Schulz ..... B60G 17/056 403/2
5,472,327 A * 12/1995 Strikis ..... F04C 18/34 418/15
5,842,837 A * 12/1998 Nakayoshi ..... F04C 11/001 417/286
6,579,070 B1 * 6/2003 Birkenmaier ..... F01C 21/0863 417/216
8,961,148 B2 * 2/2015 Hunter ..... F04C 2/344 417/216
9,546,658 B2 * 1/2017 Bohner ..... F04C 18/3442
2004/0197206 A1 * 10/2004 Henderson ..... F04C 29/02 417/360
2005/0000436 A1 * 1/2005 Muller ..... F04C 18/344 118/719
2006/0213477 A1 * 9/2006 Schulz-Andres ..... F04C 11/001 123/196 R
2007/0059187 A1 * 3/2007 Lo Biundo ..... F04C 23/00 417/364
2008/0166247 A1 * 7/2008 Holzemer ..... F04B 41/06 417/410.4
2013/0017114 A1 * 1/2013 Nakamura ..... F04C 29/0071 418/209
2016/0377303 A1 * 12/2016 Staffend ..... F04C 29/04 165/45

FOREIGN PATENT DOCUMENTS

DE 102016222288 A1 5/2018
DE 112016004874 T5 6/2018
EP 2626510 * 8/2013 ..... F01C 21/106
WO 2009035640 A1 3/2009

* cited by examiner

VACUUM PUMP SEALING ELEMENT

CROSS REFERENCE TO RELATED APPLICATIONS

This application claims priority to German Patent Application No. 10 2018 105 142.5, filed Mar. 6, 2018, the contents of such application being incorporated by reference herein.

FIELD OF THE INVENTION

The invention relates to a rotary pump, in particular a vacuum pump for a motor vehicle, featuring: a delivery space comprising an inlet on a low-pressure side and an outlet on a high-pressure side; at least one rotor which is arranged in the delivery space and delivers a fluid from the inlet into the delivery space to the outlet from the delivery space; and a drive shaft which is connected in drive terms to the rotor.

SUMMARY OF THE INVENTION

An aspect of the invention is an improved the rotary pump.

One aspect of the invention relates to a rotary pump, in particular a vacuum pump, for example a vacuum pump for a motor vehicle, featuring: a delivery space comprising an inlet on a low-pressure side and an outlet on a high-pressure side; at least one rotor which is arranged in the delivery space and delivers a fluid from the inlet into the delivery space to the outlet from the delivery space; and a drive shaft which is connected in drive terms to the rotor. The rotary pump also comprises a housing part which delineates the delivery space at least axially. In order to seal the delivery space off, the rotary pump comprises at least one sealing element which together with the housing part forms a radial sealing gap in a sealing region. The sealing element and the housing part preferably also form an axial gap together. The axial gap is advantageously larger than the radial sealing gap.

The terms "axial" and "radial" refer in particular to the rotary axis of the drive shaft and/or rotor, such that the expression "axial" denotes in particular a direction extending parallel to or coaxial with the rotary axis. Furthermore, the expression "radial" denotes in particular a direction extending perpendicular to the rotary axis. A "radial extent" is in particular intended to mean an extent along or parallel to a radial direction. An "axial extent" is in particular intended to mean an extent along or parallel to an axial direction.

The rotor preferably comprises: a delivery element support featuring at least one rotor slot; and at least one delivery element which is axially and radial guided in the rotor slot and which sub-divides the delivery space into at least two delivery cells. The delivery element support is advantageously formed integrally with the drive shaft.

The at least one sealing element is connected, secured against shifting and/or rotating, to the drive shaft and/or rotor, in particular the delivery element support. Preferably, the at least one sealing element is integrally formed by the drive shaft and/or rotor, in particular the delivery element support. Being "integrally" formed is in particular intended to mean molded in one piece, such as for example by being manufactured from a casting, in a sintering method and/or by being manufactured in a single-component or multi-component injection method or advantageously from an individual blank. The sealing element is advantageously formed by the material of the drive shaft and/or rotor, in particular the delivery element support. The at least one sealing element is preferably formed from a blank or from a material, for example a metal powder in a sintering method or a plastic or metal in an injection-molding method, together with the rotor, in particular the delivery element support, or together with the drive shaft or together with the rotor, in particular the delivery element support, and the drive shaft. The sealing element can in principle be connected to the drive shaft and/or rotor, in particular the delivery element support, in a material fit, for example by a fusing process, a gluing process, an integral molding process or the like. It is also in principle conceivable for the sealing element to be connected to the drive shaft and/or rotor, in particular the delivery element support, in a force fit and/or in a positive fit, for example by being pressed on, toothed or the like.

The drive shaft is preferably mounted, in particular in a sliding manner, in at least one bearing region in the housing part. The bearing region is advantageously formed as a slide bearing region. In the bearing region, an outer circumferential surface of the drive shaft can form a radial bearing gap, which serves for example to lubricate the bearing region, with an inner circumferential surface of an opening or bore in the housing part. An average distance between the outer circumferential surface of the drive shaft and the inner circumferential surface of the opening in the housing part is preferably smaller than an average extent of the radial sealing gap which the sealing element forms together with the housing part, i.e. the radial bearing gap is smaller or narrower in the radial direction than the radial sealing gap which the sealing element forms. The sealing element is preferably arranged such that it does not contact the housing part. The radially orientated outer circumferential surface of the sealing element preferably lacks any contact with the housing part. A radial and/or axial guide for the sealing element is preferably lacking in the housing part.

An axial extent of the bearing region or radial bearing gap is at least twice as large, advantageously at least three times as large and particularly advantageously at least four times as large, as an axial extent of the sealing region or radial sealing gap.

The bearing region (and therefore the radial bearing gap) and the sealing region (and therefore the radial sealing gap) are preferably formed completely outside the delivery space of the rotary pump. The radial sealing gap can extend up to an axial end-facing side of the delivery space. The radial sealing gap is preferably formed between the delivery space and the radial bearing gap in the axial direction of the rotary pump. The axial gap between the sealing element and the housing part is preferably arranged axially between the radial sealing gap and the radial bearing gap.

The drive shaft is preferably mounted in the housing part, in particular in a sliding manner, in at least two bearing regions which are axially spaced from each other. The radial bearing gap in each of the bearing regions is preferably smaller in the radial direction than the radial sealing gap. Advantageously, the axial extent of each of the bearing regions is at least twice as large, advantageously at least three times as large and particularly advantageously at least four times as large, as the axial extent of the radial sealing gap.

Preferably, the sealing element radially seals the rotary pump off on an axial end-facing side, such that no fluid or as little fluid as possible can escape from the delivery space.

The sealing element can form a compensation device which can compensate for production tolerances along the drive shaft.

The sealing element preferably exhibits an outer diameter which is larger than or equal to an outer diameter of the rotor, in particular the delivery element support. It is in principle conceivable, in particular when the outer diameter of the sealing element is larger than the outer diameter of the rotor, in particular the delivery element support, for the sealing element to axially delineate the delivery space. The sealing element preferably exhibits an outer diameter which is larger than an outer diameter of the drive shaft, in particular the drive shaft in the bearing region.

The rotor, in particular the delivery element support, preferably comprises a sealing element on each of its two axial end-facing sides, wherein the axial extent of a bearing region is larger than the sum of the axial extents of the radial sealing gaps of the two sealing elements.

The rotor can comprise or form a separate delivery element support which can be connected to the drive shaft in a positive fit, in a force fit and/or in a material fit such that the rotor or delivery element support cannot rotate relative to the drive shaft and preferably also cannot be linearly shifted relative to the drive shaft. To this end, the rotor or delivery element support can for example be pressed and/or fused or screwed onto the drive shaft. The delivery element support can consist of one part, featuring a central opening, or can consist of two half-shells which are joined to each other and in the process connected to the drive shaft, for example in a positive fit, in a force fit and/or in a material fit. The delivery element support can participate in forming the at least one sealing element, wherein an outer diameter of the sealing element and an outer diameter of the rotor or delivery element support can be substantially identical in this case. Alternatively, the drive shaft can participate in integrally forming the at least one sealing element. In this case, the outer diameter of the sealing element formed by the drive shaft can again be substantially equal in size to an outer diameter of the rotor or delivery element support.

When the rotary pump is assembled, the rotor is preferably arranged completely within the delivery space. The rotor preferably forms delivery cells, for example together with another rotor or with the aid of delivery elements such as teeth, vanes, pendulum sliders, etc., wherein the delivery cells deliver the fluid from the inlet into the delivery space to the outlet from the delivery space, wherein the fluid can be compressed in the delivery space if for example the rotor is arranged eccentrically, or the fluid pressure can be increased if the fluid is incompressible.

The rotor or, respectively, at least a part of the rotor, in particular the delivery element support if the rotary pump is formed as a vane cell pump or pendulum slider pump, and the sealing element can be formed in one piece with the drive shaft, i.e. the drive shaft can for example participate in forming only the part of the rotor or only the delivery element support which can accommodate the vanes, pendulums, etc. which are then guided along an inner circumferential wall of the delivery space and form the delivery cells together with the inner circumferential wall when the rotary pump is in operation. In this case, the rotor is formed by the delivery element support and said delivery elements, such as for example vanes or pendulums, wherein the delivery element support is preferably formed in one piece with the drive shaft. Alternatively, the drive shaft can form the entire rotor, for example a toothed wheel which meshes with another toothed wheel which can be guided via its radial outer circumferential side on the inner circumferential wall of the delivery space.

If the fluid is not only delivered but simultaneously compressed, and/or a pressure level of the fluid is raised, as it is transported in the delivery space from the inlet to the outlet, the rotor can be arranged eccentrically in the delivery space, which then results in variable-volume delivery cells when the rotor is rotated.

The housing part which axially delineates the delivery chamber, such as for example a base and/or cover which axially seals the delivery chamber, can form a surface which axially faces the delivery chamber. An immersion pocket, which is axially open towards the delivery space, can be formed in this surface, wherein the at least one sealing element extends into said pocket. An axial extent or depth of the immersion pocket is preferably larger than the axial extent of the sealing element, such that production tolerances of the drive shaft can for example be compensated for using the sealing element if it for example has an outer diameter which at least substantially corresponds to or is larger than an outer diameter of the rotor or delivery element support.

The immersion pocket is advantageously a recess which is incorporated into the housing part and which the sealing element axially extends into or is arranged in when the rotary pump is assembled. The sealing element is advantageously not guided in the immersion pocket. The immersion pocket is arranged in the housing part adjacent to the delivery space and in front of the opening which forms the bearing region for the drive shaft, such that a circumferential groove in the housing part results which preferably is immediately adjacent to the delivery space. The immersion pocket is preferably embodied to be axially open towards the delivery space and radially open towards the drive shaft. The immersion pocket can be incorporated in the cover and/or base of the delivery space. An outer diameter of the immersion pocket can be equal to, smaller than or larger than an outer diameter of the delivery space. The outer diameter of the immersion pocket is preferably intended here to mean the distance between two points in the radially outer circumferential surface of the immersion pocket which lie opposite each other across a longitudinal center axis of the delivery space.

An axial extent of the immersion pocket shall in particular be larger than a maximum axial clearance of the drive shaft, which is for example determined by production and/or fitting tolerances of the housing and/or the connection between the rotor and the drive shaft. The axial extent of the immersion pocket is advantageously at least twice and particularly advantageously at least three times as large as the axial extent of the bearing region.

The housing of the rotary pump can for example comprise a cover, which seals the delivery space on a first axial side or at a first axial end, and a base which is arranged axially opposite the cover across the delivery space and seals a second axial side of the delivery space, wherein the base can be formed together with the housing as a unit, such that the delivery space is cup-shaped and can be sealed by the cover.

As already mentioned, the immersion pocket can be incorporated in the cover and/or base which axially delineate the delivery chamber. If each axial end respectively comprises an immersion pocket, then the immersion pockets in the base and cover and the sealing elements which protrude into them or are arranged in them can exhibit identical or different diameters and identical or different axial extents. In this case, the two sealing elements are preferably formed identically.

The radial sealing gap, which is formed by a radial outer circumferential surface of the sealing element and by a radial inner circumferential surface of the immersion pocket which faces the sealing element, can for example be filled with a fluid in order to radially seal the delivery chamber off. The inward flow of the fluid into the immersion pocket can for example be a leakage flow along the drive shaft in the bearing gap, and/or a fluid—in particular a fluid which is delivered by a fluid delivery pump—can be channeled directly into the immersion pocket via at least one channel.

The drive shaft can comprise an axial groove in order to assist in feeding the fluid into the immersion pocket. The sealing gap can exhibit the same radial extent or gap thickness throughout over its axial extent, i.e. the radial outer circumferential surface of the sealing element and the radial inner circumferential surface of the immersion pocket extend parallel to each other. Alternatively, the sealing gap can exhibit a radial gap thickness which changes over its axial extent, can for example be cuneiform, can comprise regions of decreasing and increasing gap thickness, or can exhibit otherwise different gap thicknesses. At least the radial outer circumferential surface of the sealing element can be roughened or exhibit a profile which can be advantageous for the radial seal, at least in a circumferential axial partial region.

The drive shaft is mounted, in particular in a sliding manner, in the housing or, respectively, the housing part outside the delivery space. The drive shaft comprises at least one bearing region. The sealing element is preferably arranged axially between a bearing region and the delivery space in the immersion pocket. An axial extent of the bearing region of the drive shaft is preferably substantially larger than an axial extent of the sealing element, in particular the immersion pocket. The axial extent of the bearing region of the drive shaft is advantageously at least twice, particularly advantageously at least three times and most particularly advantageously at least four times as large as the axial extent of the sealing element, in particular the immersion pocket.

The rotor slot of the delivery element support preferably extends axially into the drive shaft, such that the rotor slot axially overlaps in the region of the rotor slot. The rotor slot advantageously extends axially out of the delivery space, at least on an axial side. The rotor slot advantageously extends axially into a bearing region of the drive shaft, at least on an axial side. A lubricant and/or sealant, in particular a liquid such as for example oil, can thus enter the delivery space from the bearing region of the drive shaft, in order for example to lubricate moving parts of the rotor and/or to seal the delivery cells of the delivery space off from each other.

The rotor slot can exhibit an axial extent or length which is at least as long as the axial extent or length of the rotor plus the axial extent of the at least one sealing element or the axial extent of the immersion pocket. The axial extent or length of the rotor slot is preferably larger. An axial fitting extent or fitting length of the rotor is preferably at least as long as the axial extent of the rotor plus a maximum axial clearance of the drive shaft. The fitting extent or fitting length is preferably intended here to refer to the region of the rotor slot in which for example a vane of the rotor can be moved in the rotor slot transverse to the rotary axis without hindrance, irrespective of for example an axial clearance of the drive shaft.

The sealing element is particularly preferably formed as an axial extension of the delivery element support, which extends axially out of the delivery space into the housing part. This extension is preferably not guided and/or mounted and/or centered in the housing part. The drive shaft is advantageously guided and/or mounted and/or centered only in the at least one bearing region and not in the sealing region provided by the at least one sealing element or extension.

A second aspect of the invention relates to a pump unit featuring: a first rotary pump featuring a delivery space in which at least one rotor is arranged which delivers a first fluid from an inlet into the delivery space on a low-pressure side of the first rotary pump to an outlet from the delivery space on a high-pressure side of the first rotary pump; a second rotary pump featuring a delivery space in which at least one rotor is arranged which delivers a second fluid from an inlet into the delivery space on a low-pressure side of the second rotary pump to an outlet from the delivery space on a high-pressure side of the second rotary pump; and a drive shaft for driving the two rotary pumps, wherein the rotor of the first rotary pump and the rotor of the second rotary pump are connected, secured against axially shifting and rotating, to the drive shaft.

The drive shaft is a monolithic drive shaft with a continuous rotary axis, i.e. the drive shaft extends through the delivery space of the first rotary pump and through the delivery space of the second rotary pump, wherein preferably at least one axial end of the drive shaft can extend up to and out of a housing of the pump unit, in order to be connected to a drive. The drive shaft can integrally form at least a part of the rotor of the first rotary pump and/or a part of the rotor of the second rotary pump, as has been described with respect to the first aspect. At least a part of at least one of the rotors can be pressed onto the rotor shaft or otherwise connected to the rotor, secured against rotating and preferably also unable to be linearly moved or adjusted in the axial direction, see also in this respect the description of the drive shaft with respect to the first aspect.

The first fluid and the second fluid are preferably different fluids. The fluid of the first rotary pump, which can for example be a liquid delivery pump, can be a lubricating oil using which the first rotary pump and/or the second rotary pump and/or at least one assembly, for example a drive motor such as an internal combustion engine, hybrid engine or electric motor of a motor vehicle, are supplied with lubricating oil. The second fluid of the second rotary pump, which can be a gas pump or vacuum pump, can be a gas which is withdrawn for example from an assembly, in particular a brake servo of a motor vehicle, in order to generate a vacuum.

The first rotary pump and/or second rotary pump can in particular be a rotary pump according to the first aspect, featuring a sealing element which the rotor, in particular the delivery element support, and/or the drive shaft participate in forming and which together with a housing part forms a radial sealing gap. In this arrangement, the sealing element or elements can in particular compensate for a production tolerance in a distance between the rotor of the first rotary pump and the rotor of the second rotary pump, which is for example introduced into the system or arrangement by pressing at least one of the rotors, in particular one of the delivery element supports, onto the drive shaft, i.e. in other words, the sealing element which engages with the immersion pocket can form a compensation device in the assembled pump or pump unit, using which it is possible to compensate for an axial clearance in the system along the drive shaft due for example to production tolerances, without thereby lifting the seal on the delivery space.

An immersion pocket can for example be formed in a base of at least one of the delivery spaces of the rotary pumps, wherein the base generally seals the delivery space off from the environment of the pump unit. Additionally or alternatively, an immersion pocket or another immersion pocket can be formed in a cover of at least one of the rotary pumps. In the pump arrangement, the cover can be a housing part which separates the delivery space of the first rotary pump from the delivery space of the second rotary pump and which comprises an opening which the drive shaft can protrude through. In this case, the immersion pocket is formed as a radial widening of the opening in the cover, which faces the delivery space.

The rotor shaft or drive shaft can comprise a fluid groove in the region of the immersion pocket in the cover and/or base of the rotary pump. The fluid groove can preferably be formed circumferentially in the shaft. Fluid can for example flow from the immersion pocket into the rotor slot via the fluid groove, in order to lubricate the moving parts of the rotor and/or to seal the delivery cells of a delivery space off from each other.

The fluid delivery pump or liquid delivery pump can in particular be an internal-axle pump, such as for example a rotary piston pump, a piston pendulum pump, a vane cell pump, a pendulum slider pump, an internally toothed wheel pump or an internal-axle pump known in the prior art, or an external-axle pump such as for example an externally toothed wheel pump.

The gas pump or vacuum pump can in particular be an internal-axle pump, such as for example a rotary piston pump, a piston pendulum pump, a vane cell pump, a pendulum slider pump, an internally toothed wheel pump or an internal-axle pump known in the prior art, or an external-axle pump such as for example an externally toothed wheel pump.

The pump unit consisting of at least one fluid delivery pump and at least one vacuum pump can for example be attached to or provided for being attached to an engine, in particular an internal combustion engine of a motor vehicle. The drive shaft of the pump unit can be connected in drive terms to the engine, such that the pump unit is at least at times driven or, respectively, controlled or regulated in accordance with the engine or a characteristic map featuring engine-dependent parameters. Alternatively, the pump unit can be driven via a drive of its own, such as for example an electric motor.

In the following, features of the pump unit and gas pump are described in the form of claims as aspects. Any features cited in the aspects can advantageously develop the subject-matter, so far as this is not already known from the preceding description.

Aspect 1. A tandem pump, comprising:

a fluid delivery pump featuring a delivery space in which at least one rotor is arranged which delivers a fluid from an inlet into the delivery space on a low-pressure side of the fluid delivery pump to an outlet from the delivery space on a high-pressure side of the fluid delivery pump;

a vacuum pump featuring a delivery space in which at least one rotor is arranged which delivers a gas from an inlet into the delivery space on a low-pressure side of the vacuum pump to an outlet from the delivery space on a high-pressure side of the vacuum pump; and a rotor shaft which connects the rotor of the fluid delivery pump and the rotor of the vacuum pump, preferably secured against rotating, and/or with which at least one of the rotors of the fluid delivery pump or vacuum pump is integrally formed.

Aspect 2. The tandem pump according to Aspect 1, wherein at least the rotor of the fluid delivery pump is pressed onto the rotor shaft and thereby connected, secured against rotating, to the rotor shaft.

Aspect 3. The tandem pump according to any one of the preceding aspects, wherein the tandem pump comprises a compensation device in the axial direction of the rotor shaft, in order to compensate for axial production tolerances when connecting the rotor of the fluid delivery pump or the rotor of the vacuum pump to the rotor shaft.

Aspect 4. The tandem pump according to the preceding aspect, wherein the compensation device is formed in the region of the vacuum pump.

Aspect 5. The tandem pump according to any one of the preceding aspects, wherein the vacuum pump comprises a cover, which seals the delivery space on a first axial side which faces the fluid delivery pump, and a base which is arranged axially opposite the cover across the delivery space and seals a second axial side of the delivery space, wherein an immersion pocket for accommodating a sealing element is incorporated in the cover and/or base.

Aspect 6. The tandem pump according to the preceding aspect, wherein the immersion pocket exhibits an axial depth which is larger than an axial extent of the sealing element, such that a rear side of the sealing element which faces away from the rotor of the vacuum pump, and a base surface of the immersion pocket which is distanced from the rotor of the vacuum pump, form an axial gap which can form the compensation device of Aspect 3.

Aspect 7. The tandem pump according to any one of the preceding two aspects, wherein sealing fluid is fed to the immersion pocket along the drive shaft via a leakage flow from the fluid delivery pump.

Aspect 8. The tandem pump according to the preceding aspect, wherein the sealing fluid flows in via a channel which channels a fluid, preferably the fluid which is pumped in the fluid delivery pump, to the immersion pocket.

Aspect 9. The tandem pump according to any one of the preceding four aspects, wherein the sealing element is formed integrally with the drive shaft and/or the rotor.

Aspect 10. The tandem pump according to any one of the preceding five aspects, wherein the drive shaft has a preferably circumferential fluid groove in the region of the immersion pocket in the cover and/or base of the vacuum pump, and wherein the circumferential fluid groove is preferably adjacent to the sealing element.

Aspect 11. The tandem pump according to any one of the preceding six aspects, wherein the sealing element forms a radial seal on the delivery space of the vacuum pump on at least one of its end-facing sides.

Aspect 12. The tandem pump according to any one of the preceding aspects, wherein the fluid delivery pump is an internal-axle pump, such as for example a rotary piston pump, a piston pendulum pump, a vane cell pump, a pendulum slider pump, an internally toothed wheel pump or another internal-axle pump known in the prior art, or an external-axle pump such as for example an externally toothed wheel pump.

Aspect 13. The tandem pump according to any one of the preceding aspects, wherein the vacuum pump is an internal-axle pump, such as for example a rotary piston pump, a piston pendulum pump, a vane cell pump, a pendulum slider pump, an internally toothed wheel pump or another internal-axle pump known in the prior art, or an external-axle pump such as for example an externally toothed wheel pump.

Aspect 14. The tandem pump according to any one of the preceding aspects, wherein the tandem pump is provided for being attached to an internal combustion engine, preferably an internal combustion engine of an automobile, and the rotor shaft is preferably connected in drive terms to the internal combustion engine.

Aspect 15. A rotary pump featuring an axial compensation device according to any one of Aspects 3 to 13.

BRIEF DESCRIPTION OF THE DRAWINGS

Aspects of the invention will now be described in more detail on the basis of figures. Features essential to aspects of the invention which can only be gathered from the figures form part of the scope of aspects of the invention and can advantageously develop the subject-matter of the invention, alone and/or in combinations shown.

The individual figures show.

DETAILED DESCRIPTION OF THE INVENTION

Figure 1:
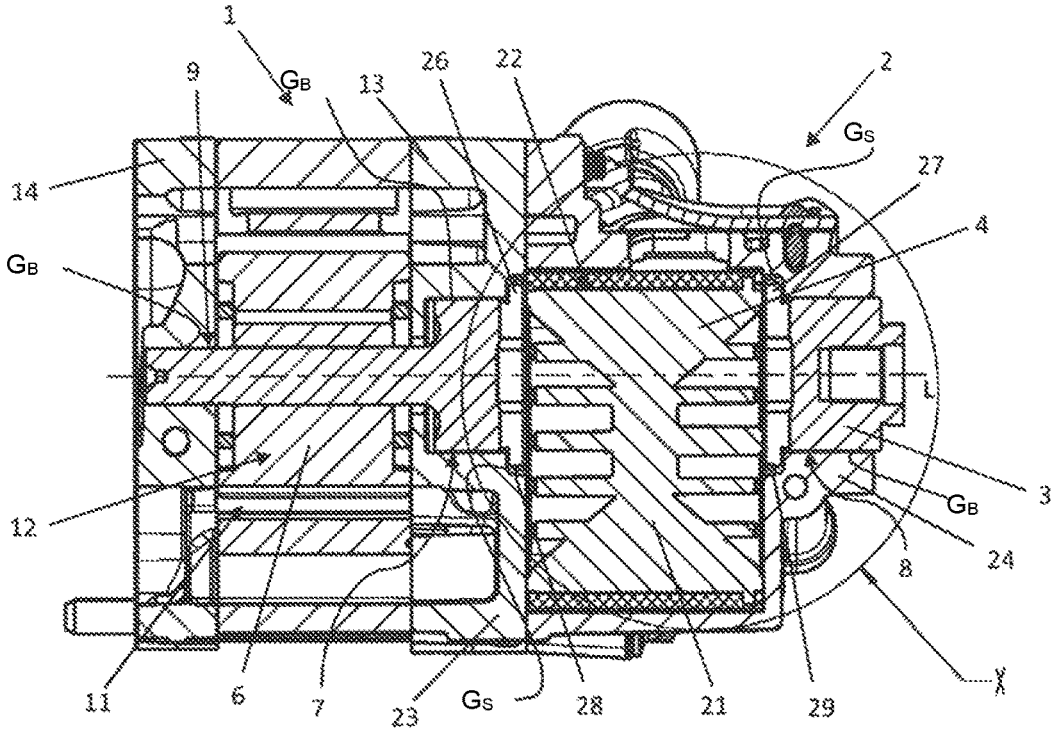
FIG. 1 a pump unit featuring a liquid pump and a gas pump in a first sectional view.

FIG. 1 shows a longitudinal section through an example embodiment of a pump unit in accordance with the invention. The pump unit comprises a first rotary pump 1, which is formed as a liquid delivery pump, and a second rotary pump 2 which is formed as a vacuum pump. The pump unit can be referred to as a tandem pump. The pump unit is provided for a motor vehicle, wherein the first rotary pump 1 is used for lubricating an internal combustion engine of the motor vehicle, and the second rotary pump 2 is used for providing a vacuum for a brake servo of the motor vehicle.

The rotary pump 1 comprises a delivery space 11 in which a rotor 12 is arranged. The rotary pump 2 comprises a delivery space 21 in which a rotor 22 is arranged. The rotor 12 and the rotor 22 are connected in drive terms to a common, continuous drive shaft 3. The rotors 12, 22 are rotary-driven by the drive shaft 3.

The rotor 12 is arranged completely within the delivery space 11. The rotor 12 comprises a delivery element support 6 and multiple delivery elements which are accommodated by the delivery element support 6 such that they can be radially shifted. In order to accommodate the delivery elements such that they can be shifted, the delivery element support 6 comprises multiple rotor slots. The delivery element support 6 is connected, secured against rotating and shifting, to the drive shaft 3. The delivery element support 6 is pressed onto the drive shaft 3. The delivery elements are formed as vanes. The first rotary pump 1 is formed as a vane cell pump.

The rotor 22 is arranged completely within the delivery space 21. The rotor 22 comprises a delivery element support 5 and a delivery element 4 which is accommodated by the delivery element support 5 such that it can be radially shifted. In order to accommodate the delivery element 4 such that it can be shifted, the delivery element support 5 comprises a rotor slot 32 which is clearly shown in FIGS. 3 to 6 and will be described in detail. The rotor slot 32 extends axially into the drive shaft 3. The delivery element support 5 is connected, secured against rotating and shifting, to the drive shaft 3. The delivery element support 5 is formed integrally with the drive shaft 3. The drive shaft 3 integrally forms the delivery element support 5. The delivery element 4 is formed as a vane. The second rotary pump 2 is formed as a vane cell pump.

The rotor 12, 22 and an inner circumferential wall of the respective delivery space 11, 21 together form delivery cells in which the fluid, be it a liquid or gas, is transported from an inlet into the delivery space 11, 21 to an outlet from said delivery space 11, 21 and can be compressed and/or raised to a higher pressure level in the process if the rotor 12, 22 is arranged eccentrically in the delivery space 11, 21.

The rotary pumps 1, 2 comprise a common pump housing. The pump housing comprises the housing parts 13, 14, 23, 24. The two housing parts 13, 23 are combined in one housing part. They are formed by a single housing part. The housing part 24 forms a base of the delivery space 21 of the second rotary pump 2 featuring a central opening through which the drive shaft 3 can be connected to a drive (not shown). The housing part 24 seals an axial end-facing side of the delivery space 21 on the side facing away from the first rotary pump 1. The delivery space 21 is sealed on the end-facing side facing the first rotary pump 1 by the housing part 23 which simultaneously forms the housing part 13 for an axial end-facing side of the delivery space 11 of the first rotary pump 1 and comprises an opening through which the drive shaft 3 extends from the delivery space 21 into the delivery space 11. The second axial end-facing side of the delivery space 11 is sealed by the housing part 14.

The drive shaft 3 is mounted in the pump housing by means of three axially spaced slide bearings. The drive shaft 3 comprises three axially spaced bearing regions 7, 8, 9. The drive shaft 3 is mounted in a sliding manner in the bearing region 9 in the housing part 14, in the bearing region 7 in the combined housing part 13, 23, and in the bearing region 8 in the housing part 24. The outer circumferential surface of the drive shaft 3 and the inner circumferential surfaces of the housing parts 14, 13, 23, 24 radially opposite it form a bearing gap $G_B$ in the bearing regions 7, 8, 9. The delivery space 11 of the first rotary pump 1 is arranged axially between the bearing region 9 and the bearing region 7. The delivery space 21 of the second rotary pump 2 is arranged axially between the bearing region 7 and the bearing region 8.

The second rotary pump 2 comprises two axially spaced sealing elements 26, 27 which extend outside the delivery space 21 into immersion pockets 28, 29 which are incorporated into the housing part 24 and into the housing part 23. The delivery space 21 is arranged axially between the sealing elements 26, 27. The sealing element 26 is arranged axially between the bearing region 7 and the delivery space 21. The sealing element 27 is arranged axially between the bearing region 8 and the delivery space 21.

The radial outer surfaces of the sealing elements 26, 27, and radial circumferential surfaces of the immersion pockets 28, 29, together form a radial sealing gap $G_S$ which is sufficiently large in the radial direction that the sealing elements 26, 27 are not radially and/or axially guided in the immersion pockets 28, 29. The radial sealing gap $G_S$ is larger or has a larger radial extent than the bearing gap $G_B$. The immersion pockets 28, 29 each exhibit an outer diameter which is larger than an outer diameter of the delivery element support 5 of the rotor 22.

Figure 2:
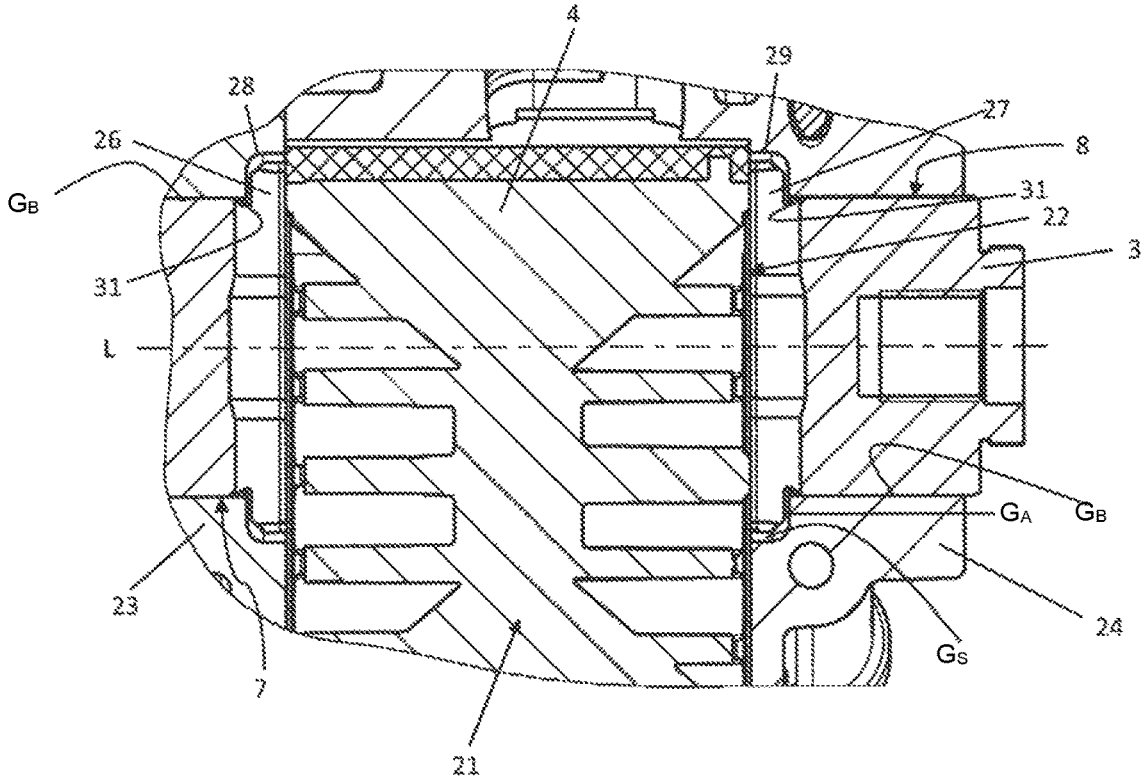
FIG. 2 an enlarged detail of a region of the gas pump from FIG. 1.

FIG. 1 includes a circled-in portion X which is shown in an enlargement in FIG. 2. FIG. 2 shows the portion X of FIG. 1 which shows a detail of the second rotary pump 2 featuring: the delivery space 21; the delivery element support 5 formed by the drive shaft 3; the delivery element 4; the housing part 24; the housing part 23; and the drive shaft 3. An immersion pocket 28, 29, which is open towards the delivery space 21 and into which the sealing elements 26, 27 extend is formed in each of the housing part 23 and the housing part 24.

The sealing elements 26, 27 are formed in one piece with the delivery element support 5 of the rotor 22 and the drive shaft 3. They radially seal the delivery space 21 off. The sealing elements 26, 27 exhibit the same outer diameter as the delivery element support 5. The sealing elements 26, 27 are formed as or by axial extensions of the delivery element support 5 which extend axially out of the delivery space 21 into the immersion pockets 28, 29, wherein the extensions exhibit an outer diameter which is larger than an outer diameter of the drive shaft 3. The extensions extend into the housing parts 23, 24 which axially delineate the delivery space 21.

An axial extent of the sealing elements 26, 27 is smaller than the axial extent or depth of the immersion pockets 28, 29, such that it is possible to compensate for an axial clearance of the drive shaft 3 using the sealing elements 26, 27. The difference in length in the axial direction between the axial depth of the immersion pockets 28, 29 and the axial extent of the sealing elements 26, 27 is preferably larger than a maximum axial clearance of the drive shaft 3. An axial extent of the radial sealing gap $G_S$ is substantially smaller than an axial extent of the radial bearing gap $G_B$.

The radial sealing gap $G_S$ can be supplied with fluid via a leakage flow which flows along the drive shaft 3 from the first delivery space 11 to the immersion pocket 28, 29. Alternatively, the immersion pockets 28, 29 can be supplied with fluid via a channel (not shown) which emerges into the immersion pocket 28, 29. The fluid forms a barrier in the radial sealing gap $G_S$ and thus prevents fluid—in this case, gas—from being able to escape from the delivery space 21.

Figure 3:
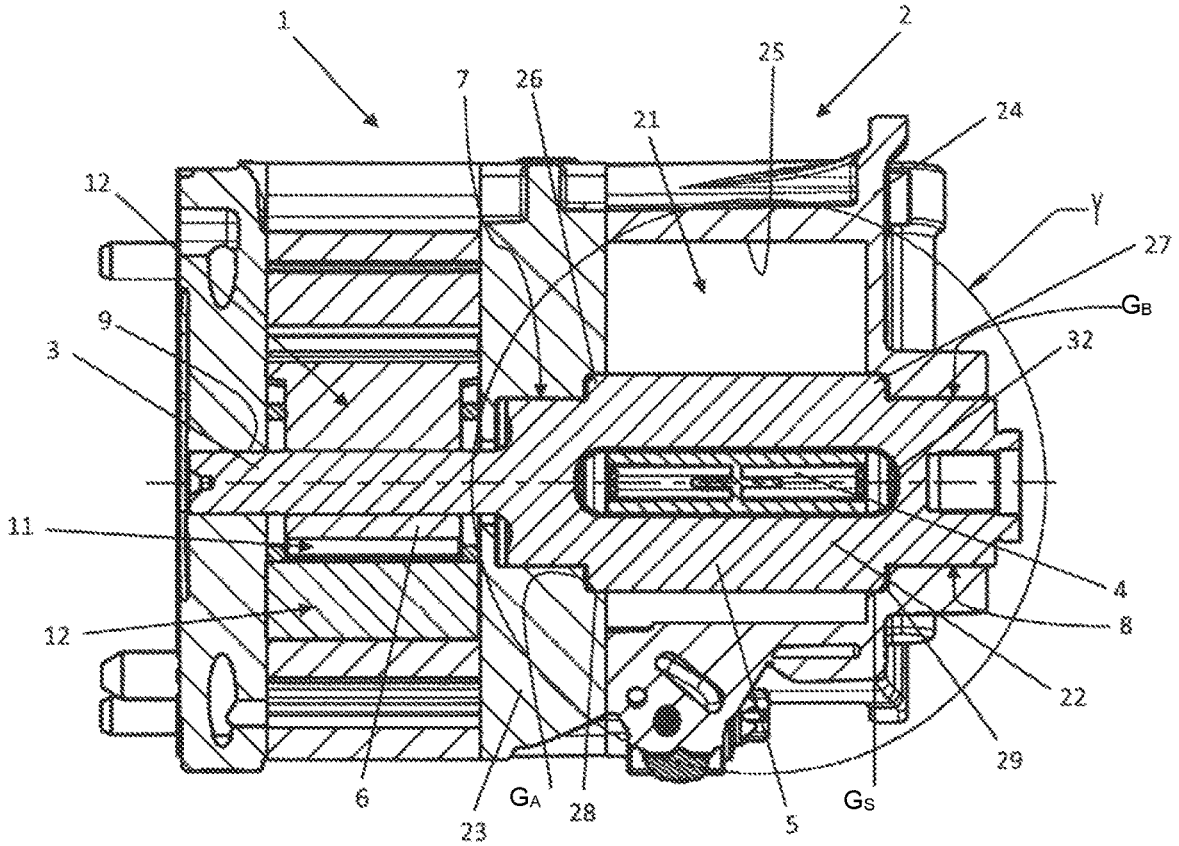
FIG. 3 a pump unit featuring a liquid pump and a gas pump in a second sectional view.

FIG. 3 shows another longitudinal section through the pump unit, which as compared to FIG. 1 shows the pump unit in a view which is rotated by a quarter turn or 90° with respect to a longitudinal axis L or rotary axis of the drive shaft 3. The region of the second rotary pump 2 is indicated in FIG. 3 by a circular detail Y. The detail Y can be seen in a magnified view in FIG. 4.

FIG. 3 shows the same as FIG. 1, but from a different angle of view. The first rotary pump 1, the second rotary pump 2 and the drive shaft 3 can be seen. The rotor slot 32 is formed in the drive shaft 3 in the region of the delivery element support 5 of the second rotary pump 2 which the drive shaft 3 participates in forming, wherein the delivery element 4 can move in the rotor slot 32 transverse to the longitudinal axis L in order to form, together with an inner circumferential wall 25 of the delivery space 21, delivery cells using which the fluid can be delivered from an inlet into the delivery space 21 to an outlet from the delivery space 21. An immersion pocket 28, 29 is incorporated in each of the housing parts 24 and 23 of the second rotary pump 2. A sealing element 26, 27 extends into each of the immersion pockets 28, 29 and radially seals the delivery space 21 off in the region of the transition from the rotor 22 into the housing part 23 and housing part 24. Because the sealing element 26, 27 is dimensioned to be smaller in the axial direction than the immersion pocket 28, 29, an axial gap $G_A$ is formed between the axial end-facing side of the sealing element 26, 27 which faces away from the rotor 22 and the base surface of the immersion pocket 28, 29 which faces the rotor 22. The immersion pockets 28, 29 in conjunction with the sealing elements 26, 27 thus together form a compensation device using which production tolerances in the axial direction, which can for example be introduced into the pump unit when pressing-on the delivery element support 6 of the first rotary pump 1, can be compensated for.

Figure 4:
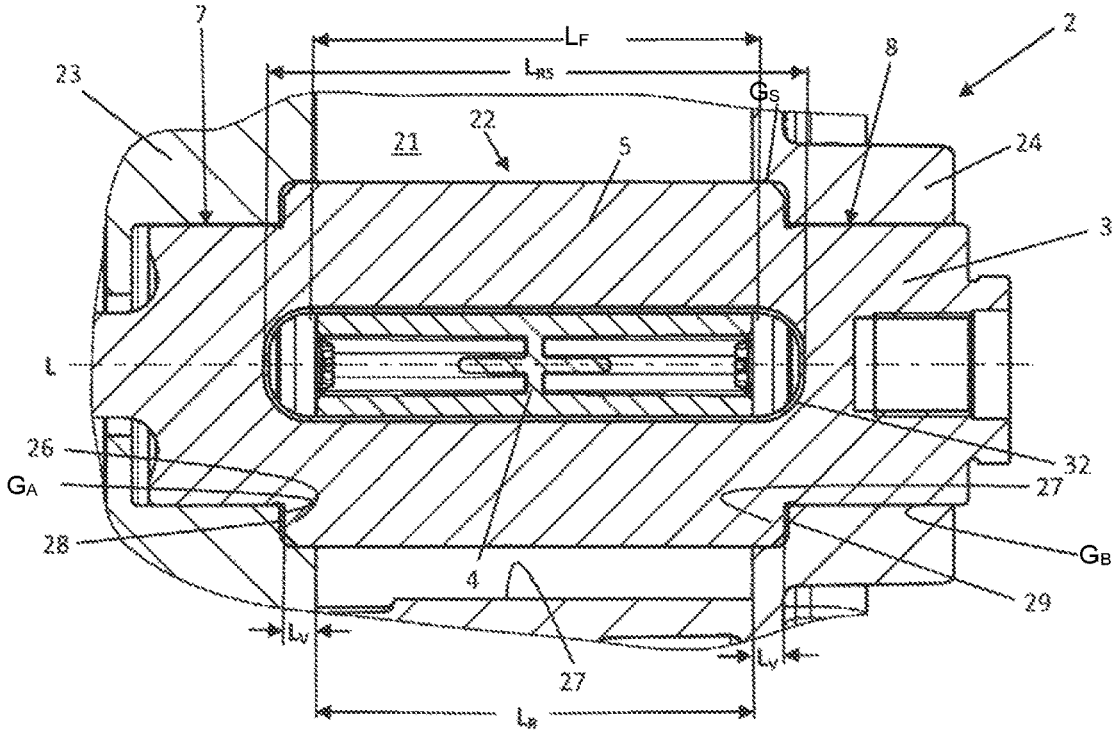
FIG. 4 an enlarged detail of a region of the gas pump from FIG. 3.

FIG. 4 shows a magnified view of a region of FIG. 3 which includes in particular the rotor slot 32. The rotor slot 32 exhibits an axial extent $L_{RS}$ and extends axially through the delivery element support 5 of the rotor 22, through the two sealing elements 26, 27, up to and into the drive shaft 3. The rotor slot 32 extends axially into the bearing regions 7, 8. The axial extent or axial length $L_{RS}$ of the rotor slot 32 shown is larger than the sum of the axial extent or axial length $L_R$ of the rotor 22 plus the axial extent $L_V$ of the two sealing elements 26, 27. Another extent which is specified is the axial fitting extent or fitting length $L_F$ which is smaller than the axial length $L_{RS}$ of the rotor slot 32 but larger than the axial length $L_R$ of the rotor 22. The axial fitting length $L_F$ refers to the region of the rotor slot 32 in which the delivery element 4 can move transverse to the longitudinal axis L of the rotary pump 2 without hindrance, i.e. without for example jamming, and in which the delivery element 4 is not pressed against one of the housing parts 23, 24 when the rotor slot 32 is shifted in the direction of the longitudinal axis L, for example in order to compensate for an axial clearance of the drive shaft 3.

A circumferential groove 31 is also formed in the drive shaft 3. The circumferential groove 31 is connected to the corresponding immersion pocket 28, 29 and the corresponding bearing region 7, 8. The groove 31 is also connected to the rotor slot 32. The rotor slot 32 extends into the circumferential groove 31. In the example embodiment, the groove 31 is divided in two and emerges into the rotor slot 32. Fluid from the immersion pocket 28, 29 and the bearing region 7, 8 can thus enter the rotor slot 32, where the fluid can for example serve to lubricate the delivery element 4 and to seal the delivery cells in the delivery space.

Figure 5:
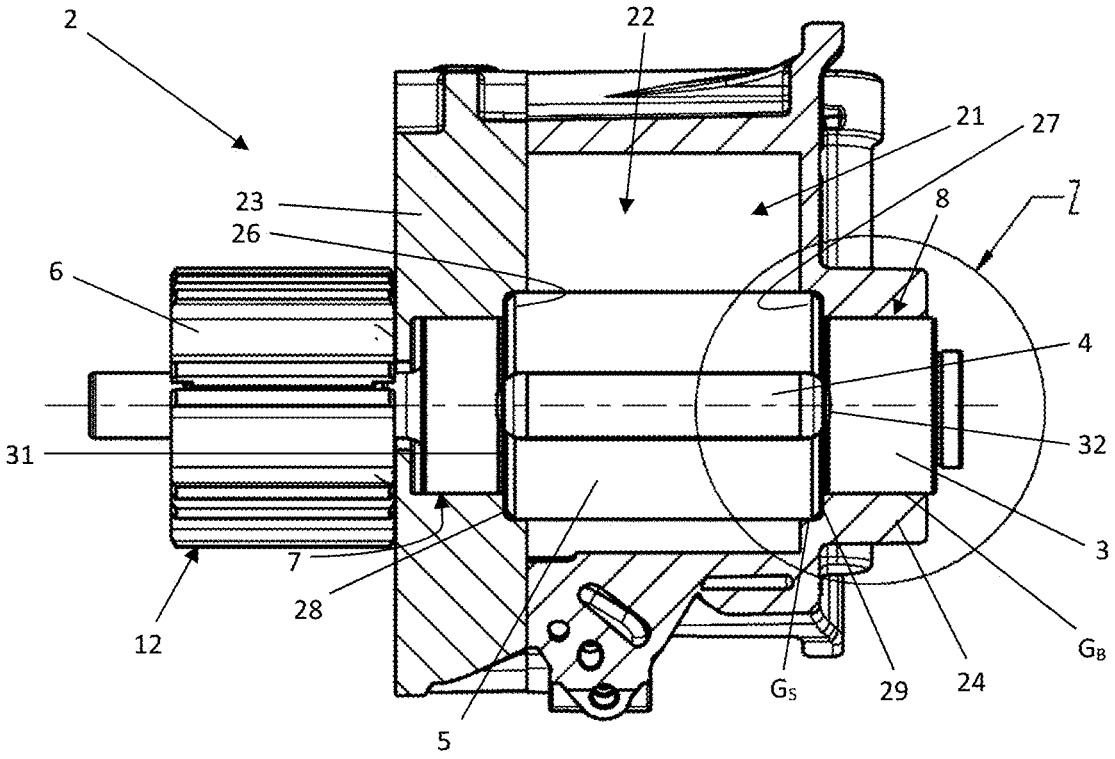
FIG. 5 a drive shaft of the pump unit, featuring a delivery element support for accommodating delivery elements of the liquid pump and a delivery element support of the gas pump in which a delivery element is arranged such that it can be shifted, wherein the housing of the gas pump is shown in section.
Figure 6:
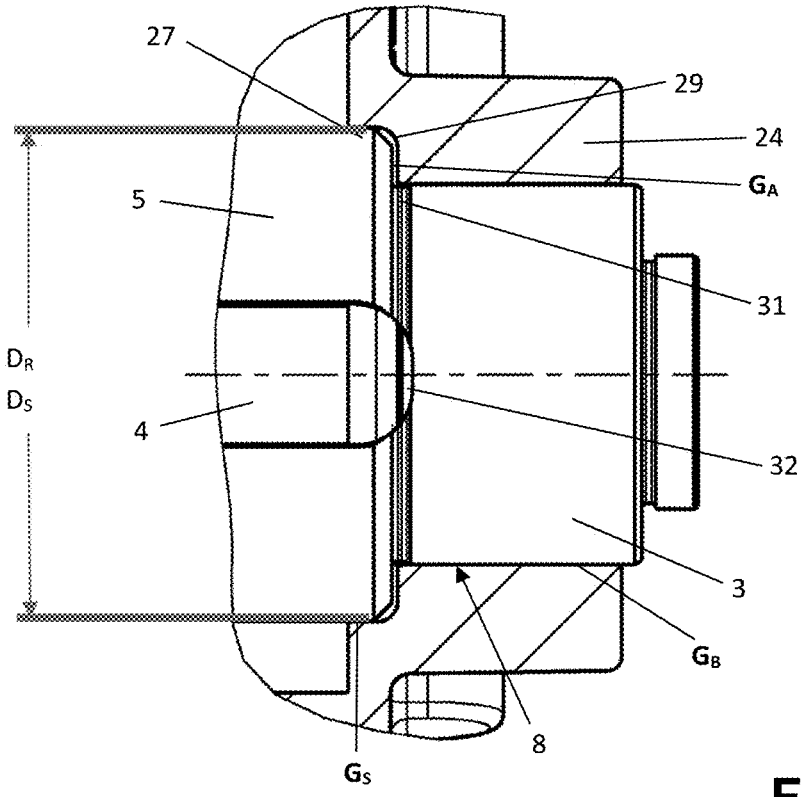
FIG. 6 an enlarged detail of the drive shaft together with the rotor of the gas pump of FIG. 5.

The circumferential groove 31 can in particular be seen in FIGS. 5 and 6. FIG. 5 shows the drive shaft 3 of the pump unit in a non-sectional view. FIG. 5 also shows the housing parts 23, 24 in a sectional view. FIG. 6 shows the detail Z from FIG. 5 in an enlargement.

The invention claimed is:

1. A rotary pump, comprising:

a delivery space comprising an inlet on a low-pressure side and an outlet on a high-pressure side of the pump;

a rotor which is arranged in the delivery space and delivers a fluid from the inlet into the delivery space to the outlet from the delivery space;

at least one housing part which delineates the delivery space at least axially;

a drive shaft which is connected in drive terms to the rotor; and at least one sealing element which is connected, secured against shifting and/or rotating, to the drive shaft and/or rotor and forms a radial sealing gap with the at least one housing part, wherein the at least one sealing element exhibits an outer diameter which is larger than or equal to an outer diameter of the rotor, wherein the at least one housing part axially seals the delivery space and forms a surface which axially faces the delivery space, wherein an immersion pocket which is axially open towards the delivery space is formed in the surface of the housing part, wherein the at least one sealing element extends into the immersion pocket, and wherein the drive shaft is mounted in at least one bearing region in the housing part and forms a radial bearing gap with the housing part in the bearing region, wherein the radial bearing gap is smaller in the radial direction than the radial sealing gap.

2. The rotary pump according to claim 1, wherein the sealing element is integrally formed by the drive shaft and/or rotor.

3. The rotary pump according to claim 1, wherein the sealing element and the housing part form an axial gap together.

4. The rotary pump according to claim 1, wherein the drive shaft is mounted in the at least one bearing region in the housing part, wherein the bearing region exhibits an axial extent which is at least twice as large as an axial extent of the radial sealing gap.

5. The rotary pump according to claim 1, wherein an axial extent of the immersion pocket is larger than a maximum axial clearance of the drive shaft.

6. The rotary pump according to claim 1, wherein the rotor comprises the sealing element on each of its two axial end-facing sides, and the sealing elements exhibit identical or different outer diameters and/or identical or different axial extents.

7. The rotary pump according to claim 1, wherein the rotary pump is a vacuum pump.

8. The rotary pump according to claim 1, wherein the immersion pocket/s is/are supplied with lubricant and/or sealant by an inward flow of a lubricant and/or sealant via the radial bearing gap with or without a lubricant and/or sealant groove, or a lubricant and/or sealant supplying bore emerges into the immersion pocket/s.

9. The rotary pump according to claim 1, wherein the rotor comprises: a delivery element support featuring at least one rotor slot; and at least one delivery element which is axially and radial guided in the rotor slot and which subdivides the delivery space into at least two delivery cells.

10. The rotary pump according to claim 9, wherein the sealing element is formed as an axial extension of the delivery element support, which extends axially out of the delivery space into the housing part.

11. A pump unit for a motor vehicle, comprising:

a first rotary pump featuring a delivery space in which at least one rotor is arranged which delivers a fluid from an inlet into the delivery space on a low-pressure side of the first rotary pump to an outlet from the delivery space on a high-pressure side of the first rotary pump;

a second rotary pump according to claim 1, featuring a delivery space in which at least one rotor is arranged which delivers a fluid from an inlet into the delivery space on a low-pressure side of the second rotary pump to an outlet from the delivery space on a high-pressure side of the second rotary pump; and a drive shaft for driving the rotary pumps, wherein the rotor of the first rotary pump and the rotor of the second rotary pump are connected, secured against axially shifting, to the drive shaft.

12. A rotary pump, comprising:

a delivery space comprising an inlet on a low-pressure side and an outlet on a high-pressure side of the pump;

a rotor which is arranged in the delivery space and delivers a fluid from the inlet into the delivery space to the outlet from the delivery space;

at least one housing part which delineates the delivery space at least axially;

a drive shaft which is connected in drive terms to the rotor; and at least one sealing element which is connected, secured against shifting and/or rotating, to the drive shaft and/or rotor and forms a radial sealing gap with the at least one housing part, wherein the at least one sealing element exhibits an outer diameter which is larger than or equal to an outer diameter of the rotor, wherein the at least one housing part axially seals the delivery space and forms a surface which axially faces the delivery space, wherein an immersion pocket which is axially open towards the delivery space is formed in the surface of the housing part, wherein the at least one sealing element extends into the immersion pocket, wherein the rotor comprises the sealing element on each of its two axial end facing sides, and the sealing elements exhibit identical or different outer diameters and/or identical or different axial extents, and wherein the drive shaft is mounted in at least one bearing region in the housing part, wherein an axial extent of each of the at least one bearing region is larger than sum of axial extents of the radial sealing gaps.

13. A rotary pump, comprising:

a delivery space comprising an inlet on a low-pressure side and an outlet on a high-pressure side of the pump;

a rotor which is arranged in the delivery space and delivers a fluid from the inlet into the delivery space to the outlet from the delivery space;

at least one housing part which delineates the delivery space at least axially;

a drive shaft which is connected in drive terms to the rotor; and at least one sealing element which is connected, secured against shifting and/or rotating, to the drive shaft and/or rotor and forms a radial sealing gap with the at least one housing part, wherein the at least one sealing element exhibits an outer diameter which is larger than or equal to an outer diameter of the rotor, wherein the at least one housing part axially seals the delivery space and forms a surface which axially faces the delivery space, wherein an immersion pocket which is axially open towards the delivery space is formed in the surface of the housing part, wherein the at least one sealing element extends into the immersion pocket, wherein the rotor comprises: a delivery element support featuring at least one rotor slot; and at least one delivery element which is axially and radial guided in the rotor slot and which subdivides the delivery space into at least two delivery cells, and wherein the rotor slot exhibits an axial extent which is as large as or larger than an axial extent of the rotor plus an axial extent of the at least one sealing element.

14. A rotary pump, comprising:

a delivery space comprising an inlet on a low-pressure side and an outlet on a high-pressure side of the pump;

a rotor which is arranged in the delivery space and delivers a fluid from the inlet into the delivery space to the outlet from the delivery space;

at least one housing part which delineates the delivery space at least axially;

a drive shaft which is connected in drive terms to the rotor; and at least one sealing element which is connected, secured against shifting and/or rotating, to the drive shaft and/or rotor and forms a radial sealing cap with the at least one housing part, wherein the at least one sealing element exhibits an outer diameter which is larger than or equal to an outer diameter of the rotor, wherein the at least one housing part axially seals the delivery space and forms a surface which axially faces the delivery space, wherein an immersion pocket which is axially open towards the delivery space is formed in the surface of the housing part, wherein the at least one sealing element extends into the immersion pocket, wherein the rotor comprises: a delivery element support featuring at least one rotor slot; and at least one delivery element which is axially and radial guided in the rotor slot and which sub-divides the delivery space into at least two delivery cells, and wherein the rotor slot exhibits an axial fitting extent which is at least as large as an axial extent of the rotor plus a maximum axial clearance of the drive shaft.

15. A rotary pump, comprising:

a delivery space comprising an inlet on a low-pressure side and an outlet on a high-pressure side of the pump;

a rotor which is arranged in the delivery space and delivers a fluid from the inlet into the delivery space to the outlet from the delivery space;

at least one housing part which delineates the delivery space at least axially; a drive shaft which is connected in drive terms to the rotor; and at least one sealing element which is connected, secured against shifting and/or rotating, to the drive shaft and/or rotor and forms a radial sealing cap with the at least one housing part, wherein the at least one sealing element exhibits an outer diameter which is larger than or equal to an outer diameter of the rotor, wherein the at least one housing part axially seals the delivery space and forms a surface which axially faces the delivery space, wherein an immersion pocket which is axially open towards the delivery space is formed in the surface of the housing part, wherein the at least one sealing element extends into the immersion pocket, wherein the rotor comprises the sealing element on each of its two axial end facing sides, and the sealing elements exhibit identical or different outer diameters and/or identical or different axial extents, wherein the drive shaft is mounted in at least one bearing region in the housing part, and wherein an axial extent of the bearing region is larger than a sum of axial extents of the radial sealing gaps.

* * * * *